US010697236B2

(12) United States Patent
King

(10) Patent No.: US 10,697,236 B2
(45) Date of Patent: Jun. 30, 2020

(54) GATE

(71) Applicant: CK Manufacturing, LLC, Lancaster, PA (US)

(72) Inventor: Crist King, Paradise, PA (US)

(73) Assignee: CK Manufacturing, LLC, Lancaster, PA (US)

( * ) Notice: Subject to any disclaimer, the term of this patent is extended or adjusted under 35 U.S.C. 154(b) by 161 days.

(21) Appl. No.: 15/967,897

(22) Filed: May 1, 2018

(65) Prior Publication Data

US 2019/0338588 A1 Nov. 7, 2019

(51) Int. Cl.

| | |
|---|---|
| ***E04H 17/16*** | (2006.01) |
| ***E06B 11/02*** | (2006.01) |
| ***E05C 1/00*** | (2006.01) |
| ***E05C 1/08*** | (2006.01) |
| ***E05C 1/14*** | (2006.01) |
| ***E05D 7/02*** | (2006.01) |
| ***E05D 7/10*** | (2006.01) |
| ***E05D 3/02*** | (2006.01) |

(52) U.S. Cl.

CPC ..... *E06B 11/022* (2013.01); *E05C 1/006* (2013.01); *E05C 1/085* (2013.01); *E05C 1/14* (2013.01); *E05D 3/02* (2013.01); *E05D 7/02* (2013.01); *E05D 7/1044* (2013.01); *E05Y 2201/474* (2013.01); *E05Y 2900/40* (2013.01)

(58) Field of Classification Search

CPC ..... E06B 11/022; E05D 3/02; E05D 7/1044; E05D 7/02; E05D 7/1055; E05D 1/14; E05D 1/085; E05D 1/006; E05Y 2900/40; E05Y 2201/474

USPC ..... 49/183, 382; 256/73

See application file for complete search history.

(56) References Cited

U.S. PATENT DOCUMENTS

| | | | | |
|---|---|---|---|---|
| 348,381 | A | 8/1886 | Cole | |
| 1,793,013 | A | 2/1931 | Robertson | |
| 3,030,717 | A | 4/1962 | Lewis | |
| 4,612,728 | A * | 9/1986 | Moriyoshi | B60J 5/047 49/193 |
| 4,811,518 | A * | 3/1989 | Ladisa | E05D 15/502 49/193 |
| 5,103,658 | A | 4/1992 | McQuade | |
| 5,367,828 | A * | 11/1994 | Hashemnia | B60J 5/047 49/193 |
| 5,829,197 | A * | 11/1998 | Oh | E05D 15/505 49/193 |
| 5,926,916 | A * | 7/1999 | Lee | E05D 15/502 16/230 |
| 5,983,453 | A * | 11/1999 | Miwa | E05D 15/505 16/231 |
| 6,010,168 | A | 1/2000 | Johnson | |

(Continued)

*Primary Examiner* — Jerry E Redman

(74) *Attorney, Agent, or Firm* — Barley Snyder

(57) ABSTRACT

A gate is provided and includes a gate body, a hinge assembly attached to a first side of the gate body, and a support bracket. The hinge assembly includes a pin assembly and an actuating assembly capable of moving a pin of the pin assembly between a retracted position and an extended position. The support bracket engages the pin in the extended position and is disengaged from the pin in the retracted position. The gate body has an axis of rotation extending through the pin when the pin engages the support bracket and is freely movable with respect to the support bracket when the pin is disengaged from the support bracket.

34 Claims, 9 Drawing Sheets

(56) References Cited

U.S. PATENT DOCUMENTS

| | | | | |
|---|---|---|---|---|
| 6,036,245 | A | 3/2000 | Schaefer | |
| 6,688,657 | B2 * | 2/2004 | Peacock | E05C 9/043 292/158 |
| 6,715,182 | B2 | 4/2004 | Cheng | |
| 6,814,244 | B1 * | 11/2004 | Hathcock | E05D 15/502 211/26 |
| 7,178,292 | B2 * | 2/2007 | Yamada | E05D 15/502 16/229 |
| 7,516,515 | B2 * | 4/2009 | Leimkuehler | E05D 15/505 16/231 |
| 7,795,532 | B2 * | 9/2010 | Walker | H05K 7/186 174/50 |
| 8,186,729 | B2 | 5/2012 | Dudley | |
| 8,220,881 | B2 * | 7/2012 | Keith | E05D 15/50 312/223.1 |
| 8,534,005 | B2 | 9/2013 | Thomas et al. | |
| 8,695,278 | B2 * | 4/2014 | Koberling | E05B 7/00 312/324 |
| 8,800,110 | B1 | 8/2014 | Stephenson | |
| 8,966,821 | B2 * | 3/2015 | Walker | E05D 7/1061 49/382 |
| 10,450,795 | B2 * | 10/2019 | Raffi | E05C 19/06 |
| 2007/0163180 | A1 * | 7/2007 | Steinberg | E05D 15/505 49/382 |
| 2009/0294747 | A1 * | 12/2009 | Stull | E05D 7/0423 256/73 |
| 2011/0175046 | A1 * | 7/2011 | Flannery | E06B 9/04 256/73 |
| 2018/0258677 | A1 * | 9/2018 | Bright | E05C 9/16 |

* cited by examiner

GATE

FIELD OF THE INVENTION

The present invention relates to a gate and, more particularly, to a gate having hinge assembly and a gate body capable of multidirectional movement through the hinge assembly.

BACKGROUND

Gates are commonly used to with fencing. Typically, these known gates include a hinge assembly positioned on one side of the gate and a locking device positioned one another side of the hinge. The hinge is secured to one section of the fence and the locking device is secure to another section of the fence. When the locking assembly is secured to the fence, the gate provides a barrier between the two sections of fence. However, when the locking device is opened, the gate is moveable, and a gate body swings about the hinge assembly. However, there is a flaw in this design, as known gates can be cumbersome because the gate body can be an obstruction when passing through the sections of fence. As a result, it is desired to have a gate that is capable of multidirectional movement so that the gate body is not an obstruction.

SUMMARY

A gate according to the invention is provided and capable of multidirectional movement. The gate includes a gate body, a hinge assembly attached to a first side of the gate body, and a support bracket. The hinge assembly includes a pin assembly and an actuating assembly capable of moving a pin of the pin assembly between a retracted position and an extended position. The support bracket engages the pin in the extended position and is disengaged from the pin in the retracted position. The gate body has an axis of rotation extending through the pin when the pin engages the support bracket and is freely movable with respect to the support bracket when the pin is disengaged from the support bracket.

BRIEF DESCRIPTION OF THE DRAWINGS

The invention will now be described by way of example with reference to the accompanying Figures, of which.

DETAILED DESCRIPTION OF THE EMBODIMENTS

Figure 1:
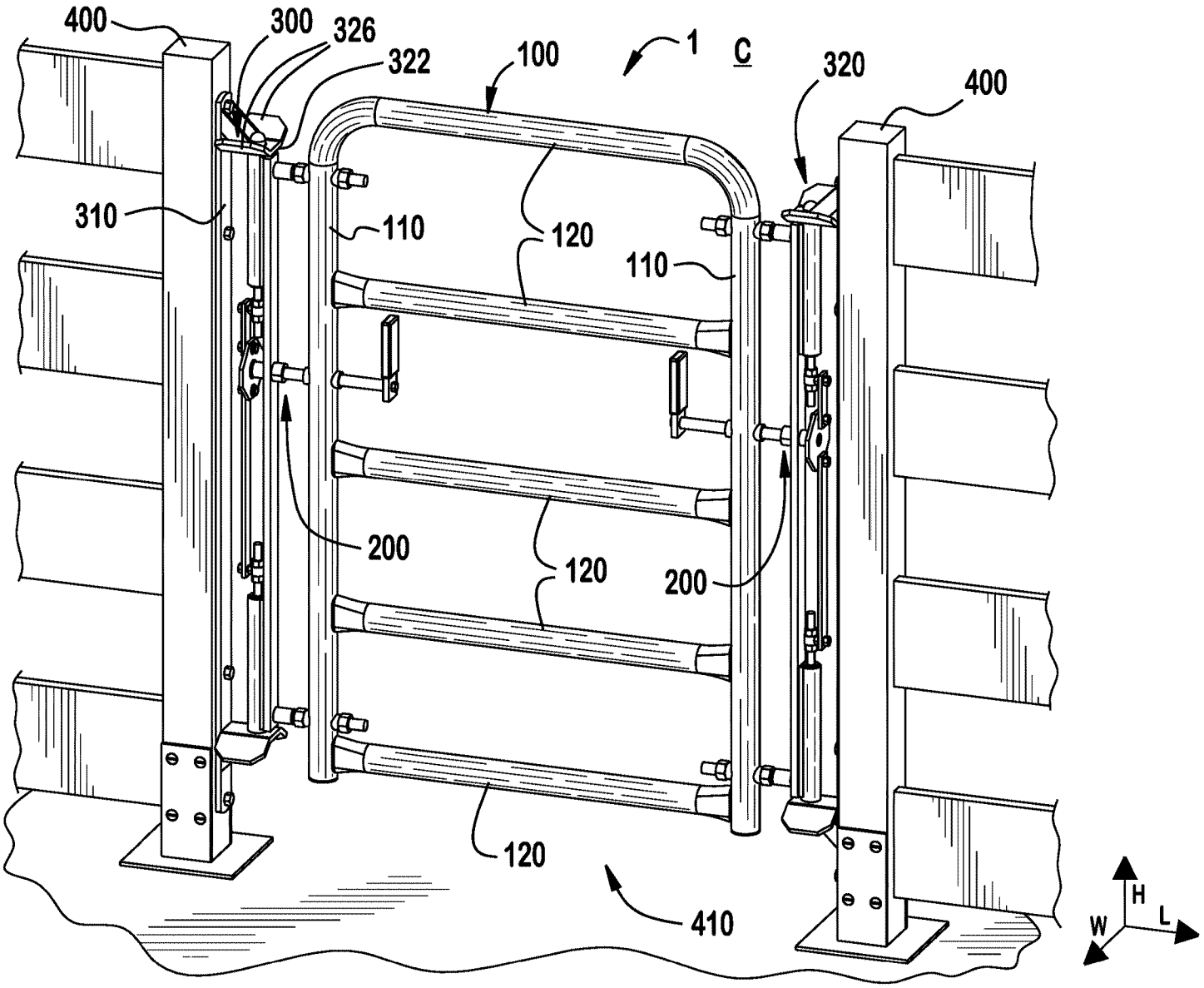
FIG. 1 is a perspective view of a gate according to the invention in a closed position.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

A gate 1 according to the invention is shown generally in FIG. 1. The gate 1 generally includes a gate body 100, a pair of hinge assemblies 200, and a pair of support brackets 300. The major components of the invention will now be described in greater detail.

Figure 2:
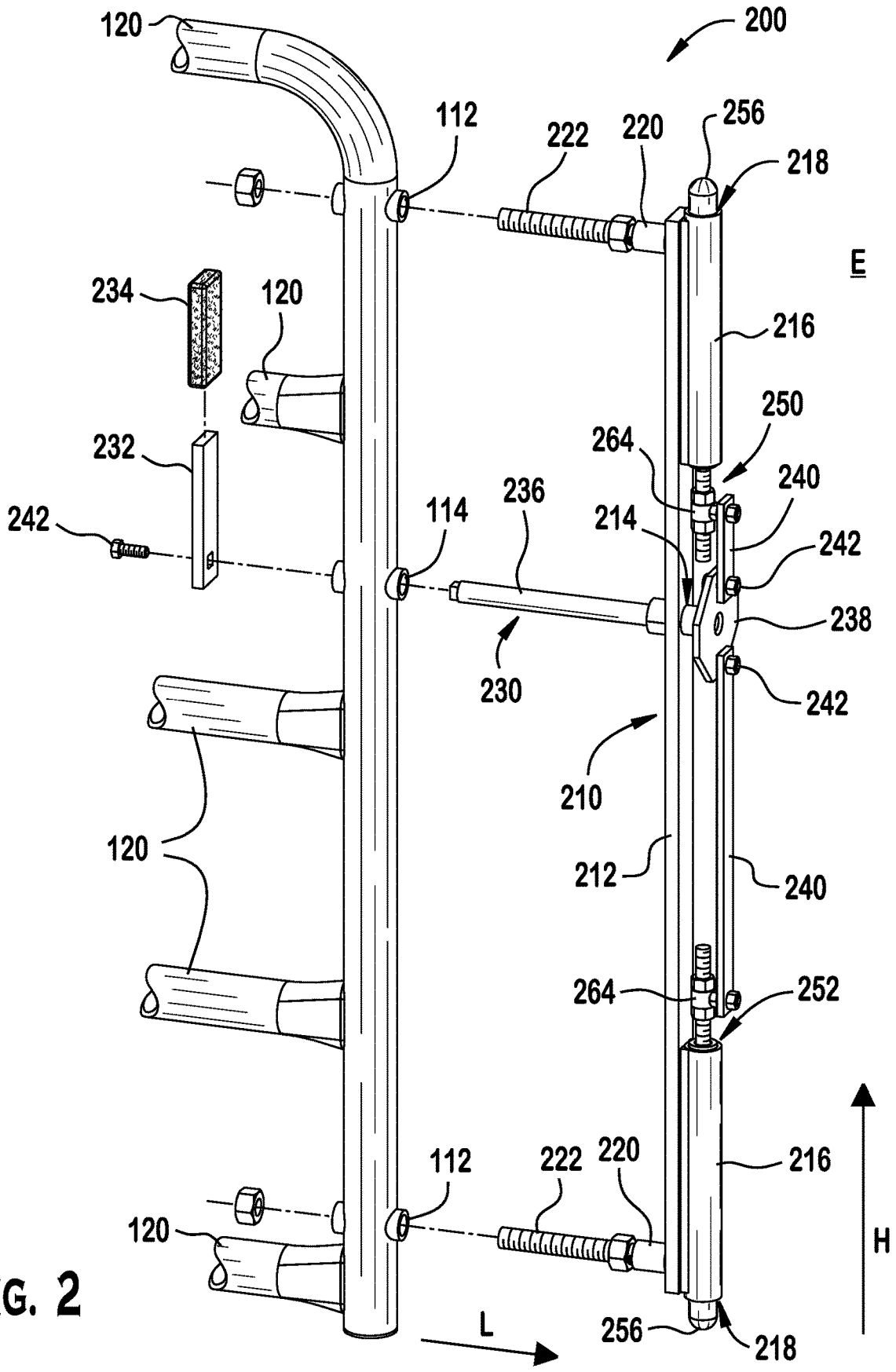
FIG. 2 is an exploded perspective view of a gate body and a hinge assembly of the gate.

The gate body 100 is shown in FIGS. 1 and 2. In an exemplary embodiment, the gate body 100 includes a pair of vertical supports 110 and a plurality of horizontal supports 120 connecting the pair of vertical supports 110. The vertical supports 110 extend along a height direction H and each vertical support 110 has a plurality of first fastener receiving passageways 112 and a second fastener receiving passageway 114 extending through the vertical support 110 in a longitudinal direction L perpendicular to the height direction H. As shown in FIG. 2, the first fastener receiving passageways 112 extend through the vertical support 110 at opposite ends of the vertical support 110 in the height direction H. The second fastener receiving passageway 114 extends through the vertical support 110 approximately centrally along the height direction H. The horizontal supports 120 extend along the longitudinal direction L between the vertical supports 110.

In an exemplary embodiment of the invention, as shown in FIGS. 1 and 2, the vertical supports 110 and horizontal supports 120 are cylindrical members formed of a metal material. In other embodiments, the vertical supports 110 and horizontal supports 120 could be elongated rectangular members or any other shape known to those with ordinary skill in the art and could be formed of any other material known to those with ordinary skill in the art, such as a plastic or wood, suitable for use as a gate body 100. Further, in alternative embodiments, the gate body 100 may have minimal spacing between the vertical supports 110 and horizontal supports 120 or may only be a single solid member omitting the separate vertical supports 110 and horizontal supports 120; all embodiments of the gate body 100 have the first fastener receiving passageways 112 and second fastener receiving passageway 114 on opposite sides of the gate body 100 which extend in the height direction H.

Figure 3:
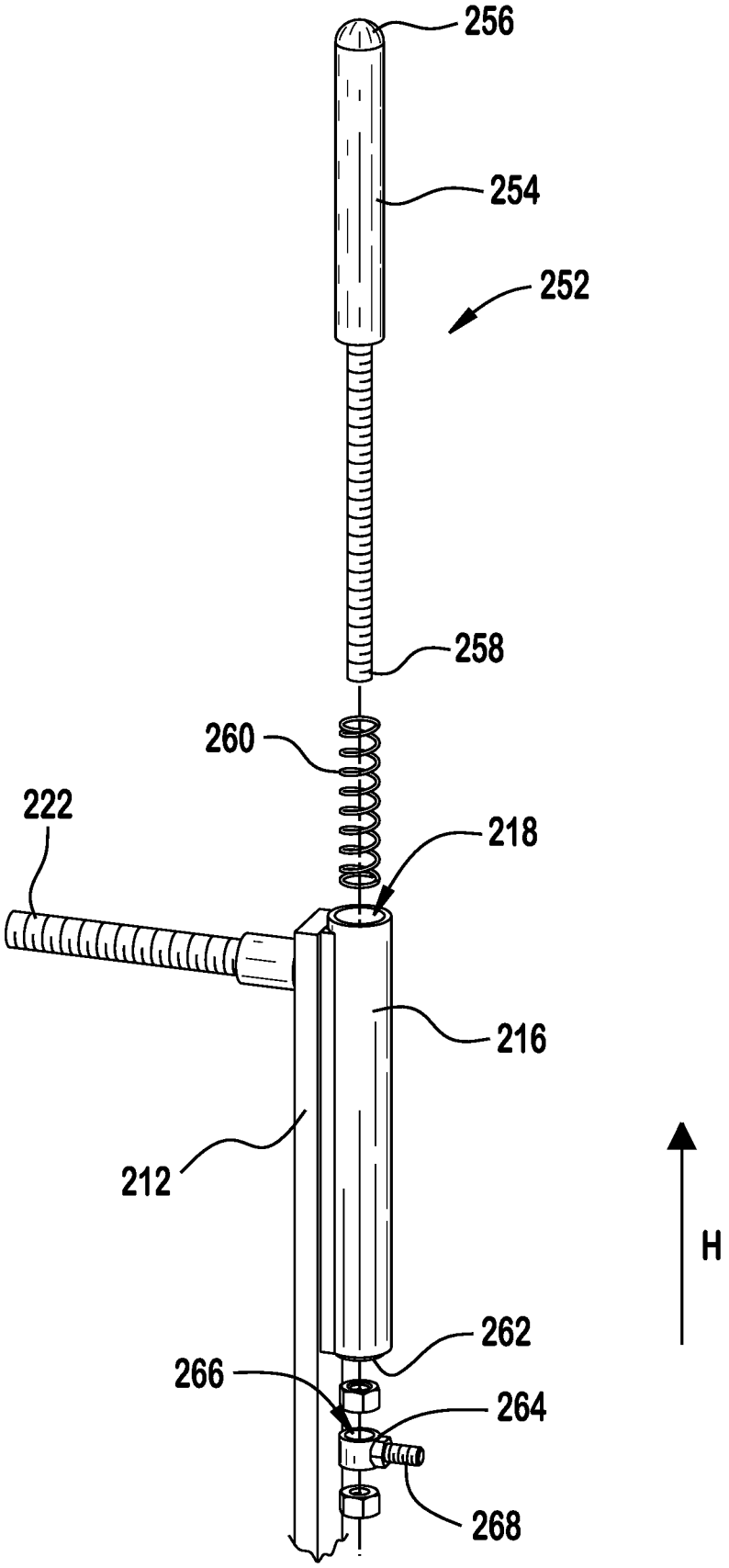
FIG. 3 is an exploded perspective view of a pin assembly of the hinge assembly.

An exemplary hinge assembly 200 of the pair of hinge assemblies 200 is shown in FIGS. 2 and 3. The hinge assembly 200 includes a hinge frame 210, an actuating assembly 230 supported by the hinge frame 210, and a pair of pin assemblies 250 movable by the actuating assembly 230. One hinge assembly 200 of the pair of hinge assemblies 200 will be described in detail with reference to FIGS. 2 and 3 below and the description applies equally to the other of the pair of hinge assemblies 200. In an exemplary embodiment, all elements of each hinge assembly 200 are formed of a metal material such as aluminum or steel. In other embodiments, the elements of each hinge assembly 200 are formed from another material such as a plastic or any other material known to those with ordinary skill in the art.

The hinge frame 210, as shown in FIGS. 2 and 3, includes a hinge bar 212, a pair of pin guides 216, a pair of frame spacers 220, and a pair of frame fasteners 222. The hinge bar 212 is an elongated member extending in the height direction H and has an actuating rod receiving passageway 214 extending through the hinge bar 212 in the longitudinal direction L. The actuating rod receiving passageway 214 extends through the hinge bar 212 approximately centrally along the hinge bar 212 in the height direction H.

Each pin guide 216 of the pair of pin guides 216 is disposed on an opposite end of the hinge bar 212 in the height direction H, as shown in FIG. 2. The pin guide 216 is a hollow cylindrical member defining a pin receiving passageway 218. Each pin guide 216 is attached to an end of the hinge bar 212 and oriented such that the pin guide 216 is aligned with the hinge bar 212 and the pin receiving passageway 218 extends along the height direction H. As shown in FIGS. 2 and 3, an end of each pin guide 216 is approximately aligned with the respective end of the hinge bar 212 in the height direction H. In the shown embodiment, each pin guide 216 is welded to the hinge bar 212. In other embodiments, each pin guide 216 may be attached to the hinge bar 212 by an adhesive, a fastener, or any other attachment known to those with ordinary skill in the art.

Each frame spacer 220, as shown in FIGS. 2 and 3, is disposed on an opposite end of the hinge bar 212 in the height direction H and is positioned on a side of the hinge bar 212 opposite the pin guide 216. The frame spacer 220 extends from the hinge bar 212 in the longitudinal direction L. Each frame fastener 222 corresponds to one frame spacer 220 and extends from the frame spacer 220 in the longitudinal direction L. In the shown embodiment, each frame fastener 222 is a threaded bolt fastener which engages a nut. In other embodiments, each frame fastener 222 may be a screw, an adhesive, a weld, or any other fastener known to those with ordinary skill in the art.

The actuating assembly 230, as shown in FIG. 2, is supported by the hinge frame 210 and includes a lever 232, an actuating rod 236, an actuating plate 238, a pair of translation bars 240, and a plurality of actuating fasteners 242.

The lever 232 is an elongated member and, in an exemplary embodiment, includes a lever cover 234 disposed over a portion of the lever 232. The lever cover 234 may be formed of a softer, tackier material than the lever 232, such as a rubber, that is easily grasped by a user.

The actuating rod 236 is an elongated cylindrical member which extends through the actuating rod receiving passageway 214 of the hinge bar 212. The actuating rod 236 has a first end connected to an end of the lever 232 and an opposite second end connected to the actuating plate 238 by an actuating fastener 242. In the shown embodiment, each actuating fastener 242 is a threaded bolt fastener which engages a female thread. In other embodiments, each actuating fastener 242 may be a screw, an adhesive, a weld, or any other fastener known to those with ordinary skill in the art.

The actuating plate 238 is a plate-shaped member fixed to the second end of the actuating rod 236. Rotation of the lever 232 imparts rotation to the actuating rod 236, which imparts rotation to the actuating plate 238 as described in greater detail below. The translations bars 240 each have a first end connected to the actuating plate 238 by an actuating fastener 242 which permits the actuating plate 238 to rotate with respect to the translation bars 240. The translation bars 240 are connected to opposite sides of the actuating plate 238 in the height direction H and extend from the actuating plate 238 in opposite directions; one of the translation bars 240 extends along the height direction H and the other translation bar 240 extends counter to the height direction H.

Figure 4:
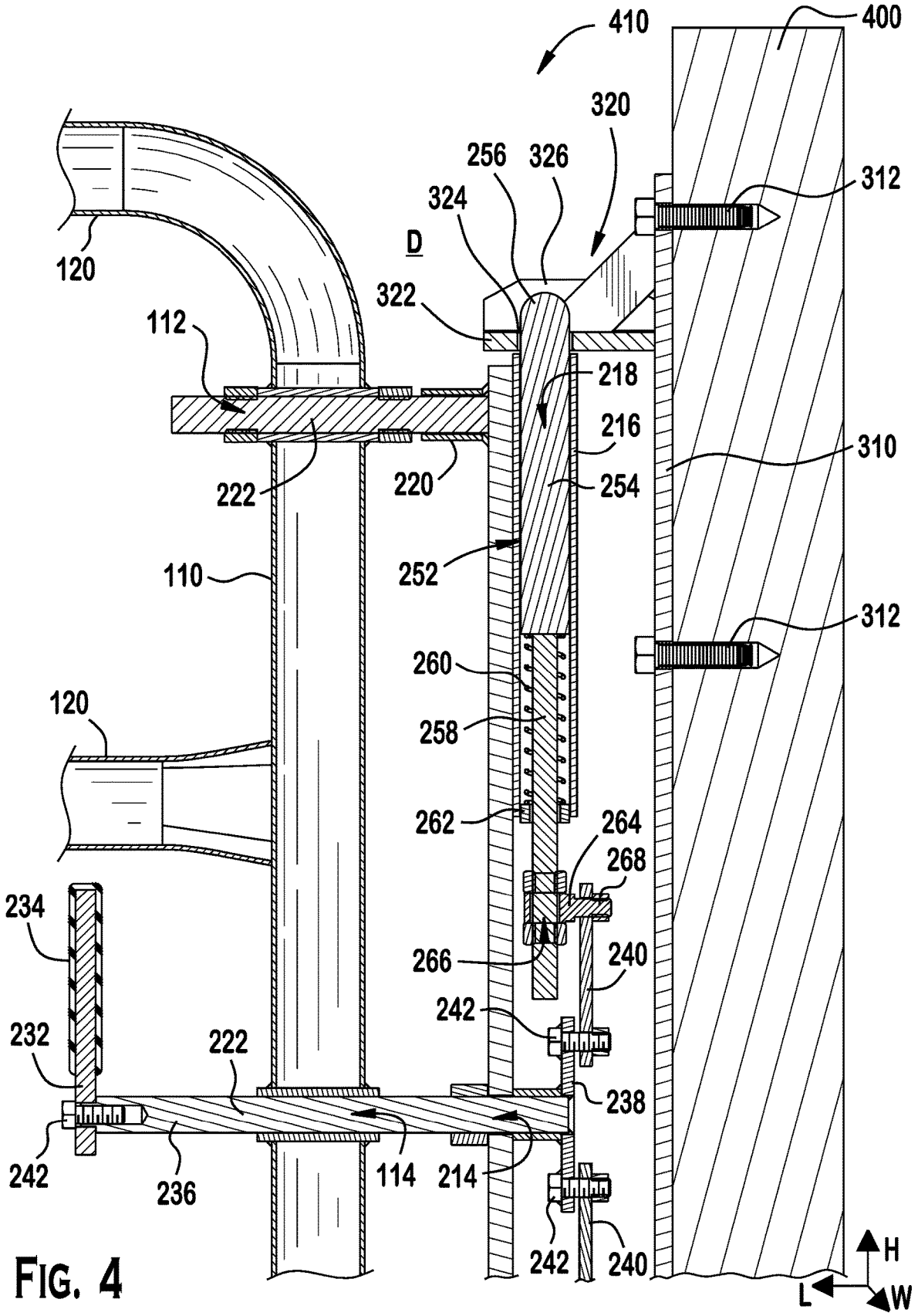
FIG. 4 is a detailed sectional front view of the gate.

The pin assemblies 250 are shown in FIGS. 2-4. Each pin assembly 250 includes a pin 252, a spring 260, a stopper 262, and a pin fastener 264. The arrangement of a pin assembly 250 within the hinge frame 210 and the connection of the pin assembly 250 to the actuating assembly 230 will only be described for one of the pair of pin assemblies 250; the other of the pair of pin assemblies 250, as shown in FIG. 2, extends in an opposite direction but otherwise is arranged and connected identically.

The pin 252 of the pin assembly 250, as shown in FIG. 3, has a threaded portion 258 extending from a first end of the pin 252 along the height direction H and a cylindrical portion 254 extending from the threaded portion 258 to an opposite second end of the pin 252 in the height direction H. The cylindrical portion 254 has a rounded tip 256 at the second end of the pin 252.

The spring 260, as shown in FIGS. 3 and 4, is sized to fit around the threaded portion 258 of the pin 252 and abut against the cylindrical portion 254. The pin 252 and spring 260 are disposed in the pin receiving passageway 218 of one pin guide 216 with the spring 260 disposed around the threaded portion 258. In an extended position E shown in FIGS. 2 and 4, the cylindrical portion 254 of the pin 252, and particularly the rounded tip 256, protrudes from a first end of the pin guide 216.

The stopper 262, as shown in FIGS. 3 and 4, is disposed in the pin guide 216 at an opposite second end of the pin receiving passageway 218 and retains the pin 252 and spring 260 within the pin receiving passageway 218. The stopper 262 may be formed of an elastically resilient material such as a rubber or may be formed of a rigid material such as a metal. In various embodiments, the stopper 262 may be removably attached to the pin guide 216, may be permanently attached to the pin guide 216, or may be monolithically formed with the pin guide 216.

The threaded portion 258 of the pin 252, as shown in FIG. 4, protrudes from the second end of the pin receiving passageway 218. The pin fastener 264 is attached to the threaded portion 258 protruding from the pin receiving passageway 218. In the embodiment shown in FIGS. 3 and 4, the pin fastener 264 has a pin fastener passageway 266 and a threaded protrusion 268. The threaded portion 258 of the pin 252 is engaged with the pin fastener passageway 266 and the threaded protrusion 268 of the pin fastener 264 is attached to a second end of one translation bar 240 opposite the first end connected to the actuating plate 238. The translation bar 240 is rotatable with respect to the pin fastener 264.

Figure 5:
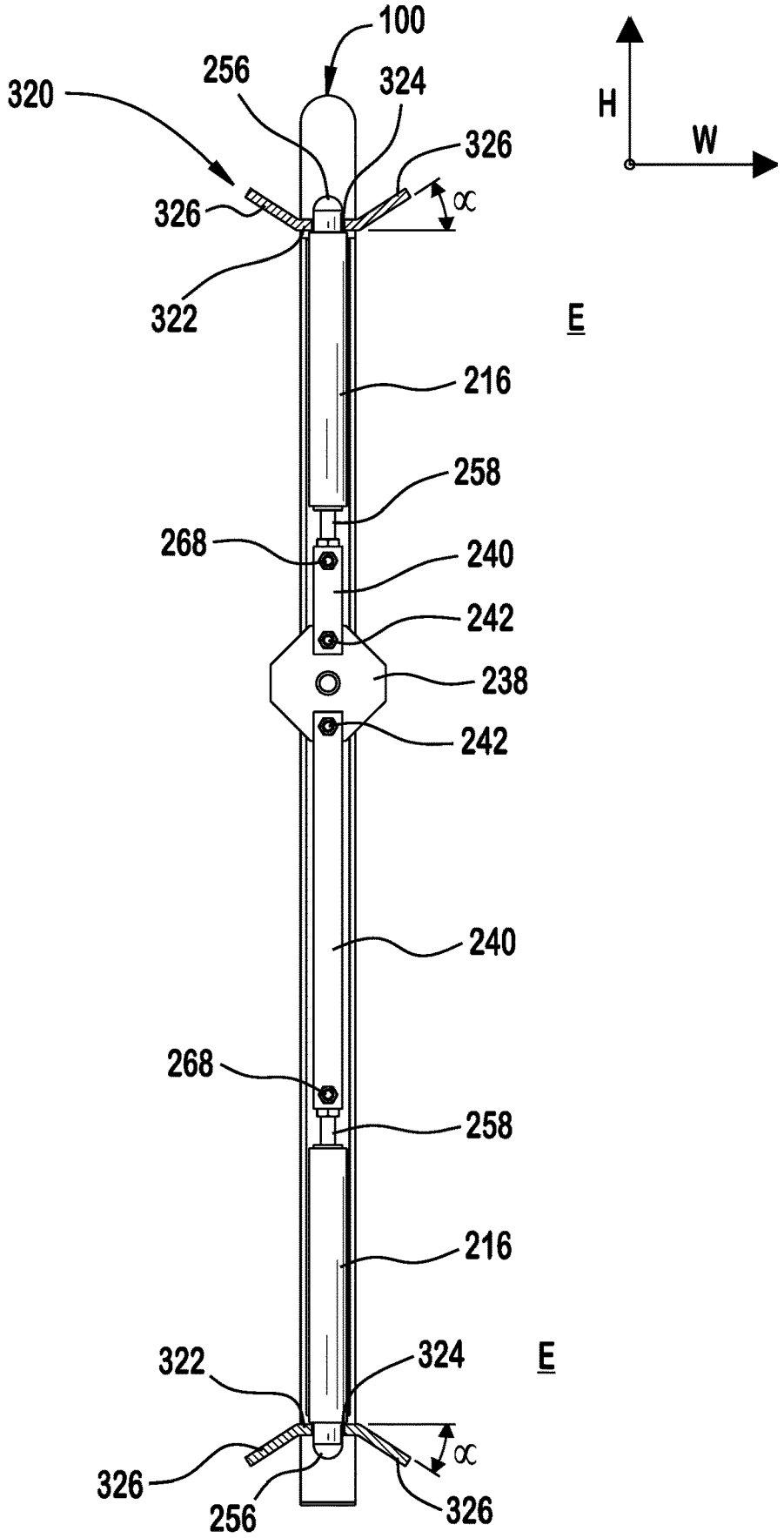
FIG. 5 is a sectional side view of the hinge assembly in an extended position and a support bracket of the gate.

The support brackets 300 are shown in FIGS. 1, 4, and 5. One support bracket 300 of the pair of support brackets 300 will be described in detail with reference to FIGS. 1, 4, and 5 below and the description applies equally to the other of the pair of support brackets 300. In an exemplary embodiment, all elements of each support bracket 300 are formed of a metal material such as aluminum or steel. In other embodiments, the elements of each support bracket 300 are formed from another material such as a plastic or any other material known to those with ordinary skill in the art.

In an exemplary embodiment, the support bracket 300 generally includes a support frame 310 and a pair of catches 320 as shown in FIGS. 4 and 5. The support frame 310 is an elongated member and one catch 320 is disposed on each end of the support frame 310 in the height direction H; the catches 320 are disposed symmetrically about a center of the support frame 310. Each catch 320, as shown in FIGS. 4 and 5, includes a central portion 322 and a pair of inclined side portions 326 disposed on each of two opposite sides of the central portion 322. The central portion 322 extends in the longitudinal direction L perpendicularly from the support frame 310 and has a pin end receiving passageway 324 extending through the central portion 322 in the height direction H. As shown in FIG. 5, each inclined side portion 326 extends from the central portion 322 at an angle α with respect to a width direction W perpendicular to the height direction H and the longitudinal direction L. In an exemplary embodiment, the catches 320 are monolithically formed with the support frame 310 of each support bracket 300.

The assembly of the gate 1 will now be described in greater detail with reference to FIGS. 1, 2, and 4.

As shown in FIGS. 1 and 2, one hinge assembly 200 is attached to each vertical support 110 and, consequently, one hinge assembly 200 is attached to each side of the gate body 100. For each hinge assembly 200, the frame fasteners 222 are inserted through and engage the first fastener receiving passageways 112 and the actuating rod 236 is inserted through the second fastener receiving passageway 114 of the vertical support 110. The attachment of the actuating rod 236 to the lever 232 retains the actuating rod 236 in the second fastener receiving passageway 114 and the actuating rod 236 is rotatable within the second fastener receiving passageway 114 with respect to the gate body 100. The frame spacers 220 adjacent the frame fasteners 222 hold the hinge bar 212 spaced apart from the vertical support 110. The lever 232 is disposed on an opposite side of the vertical support 110 from the hinge bar 212 and the rest of the hinge assembly 200 and is accessible to a user through the gate body 100.

The support brackets 300, as shown in FIGS. 1 and 4, are attached to a barrier 400 adjacent an opening 410 of the barrier 400 at which the gate 1 is installed. The support frame 310 of each support bracket 300 is aligned in the height direction H and positioned to abut the barrier 400. A plurality of support fasteners 312 fasten the support frame 310 to the barrier 400. In the shown embodiment, the support fasteners 312 are screws. In other embodiments, the support fasteners 312 may be bolts, an adhesive, or any other fastener known to those with ordinary skill in the art. One support bracket 300 is attached to the barrier 400 at each side of the opening 410; each support bracket 300 is disposed on one side of the assembled gate body 100 and hinge assemblies 200 and is positioned adjacent one hinge assembly 200.

The operation of the gate 1 to be hinged on either side and rotatable either in or out will now be described in greater detail with reference to FIGS. 1 and 5-10. In the shown embodiment, the barrier 400 is a fence and the opening 410 is a space in the fence through which a user can pass. The gate 1 is used to close the opening 410 to prevent access through the opening 410 of the barrier 400 and, when desired, the gate 1 may be opened by the user to permit access through the opening 410. In other embodiments, the barrier 400 may be any type of barrier that requires a gate for access at an opening 410, such as a solid wall.

The gate 1 is shown in a closed position C in FIG. 1. In the closed position C of the gate 1, each pin 252 of each hinge assembly 200 is in the extended position E and extends through the pin end receiving passageway 324 of one catch 320, as shown in FIGS. 4 and 5. The pin end receiving passageway 324 of each catch 320 catches one pin 252 and, by engagement of the central portion 322 with the pin 252, prevents movement of the hinge assembly 200 with respect to the corresponding support bracket 300. With each of the pins 252 engaged in one catch 320, in the embodiment shown in FIG. 1 the two pins 252 of each pin assembly 250 each engaged in one of the four catches 320, the gate 1 is in the closed position C and prevents access through the opening 410.

The user, as shown in FIGS. 1 and 5-7, can actuate the actuating assembly 230 of either hinge assembly 200 to disengage the respective hinge assembly 200 from the catches 320 of the corresponding support bracket 300. The disengagement of only one hinge assembly 200 from one support bracket 300 will be described in greater detail below but applies equally to the disengagement of the other hinge assembly 200 from the other support bracket 300.

Figure 6:
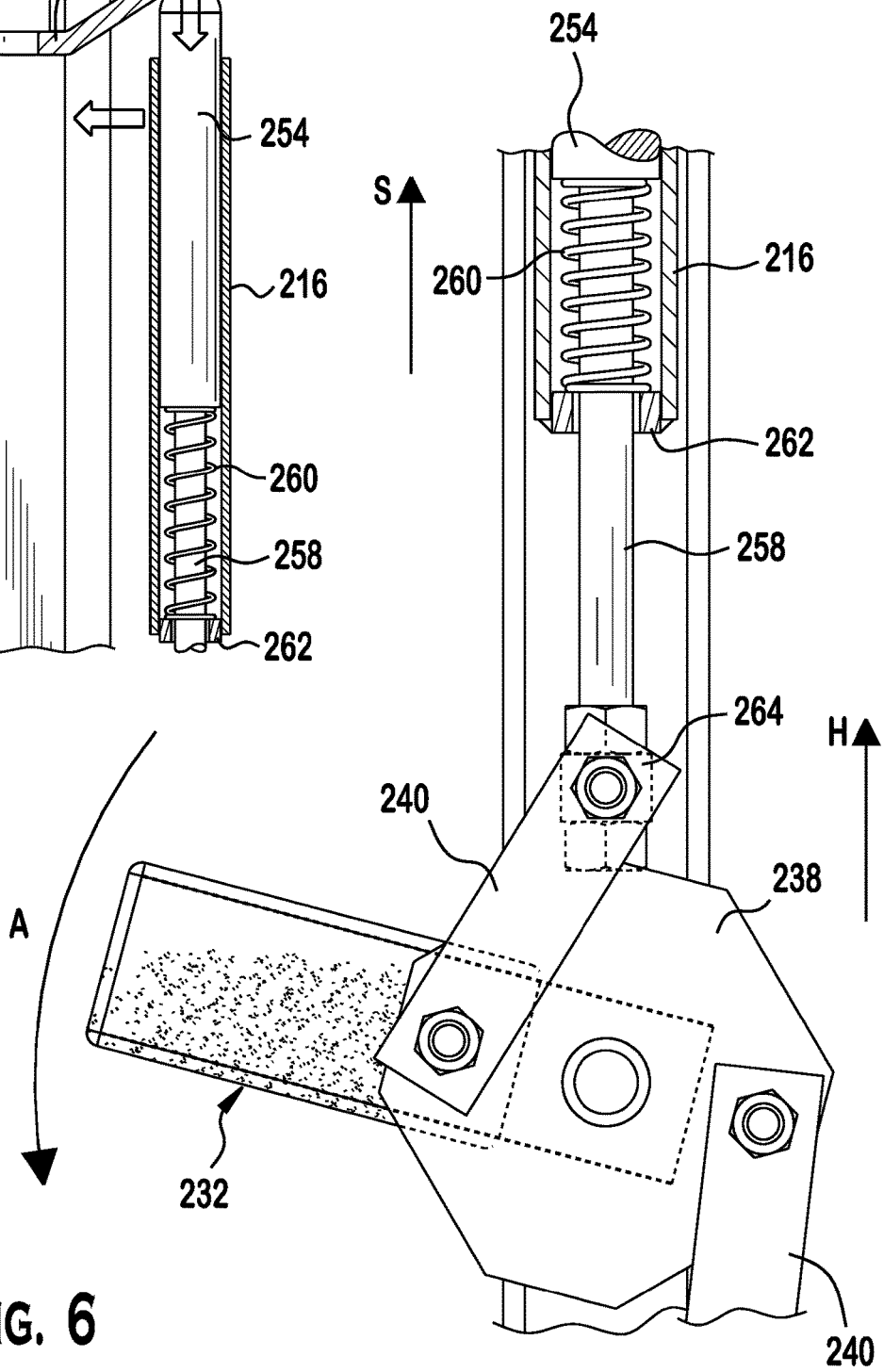
FIG. 6 is a side view of a lever of the hinge assembly.
Figure 7:
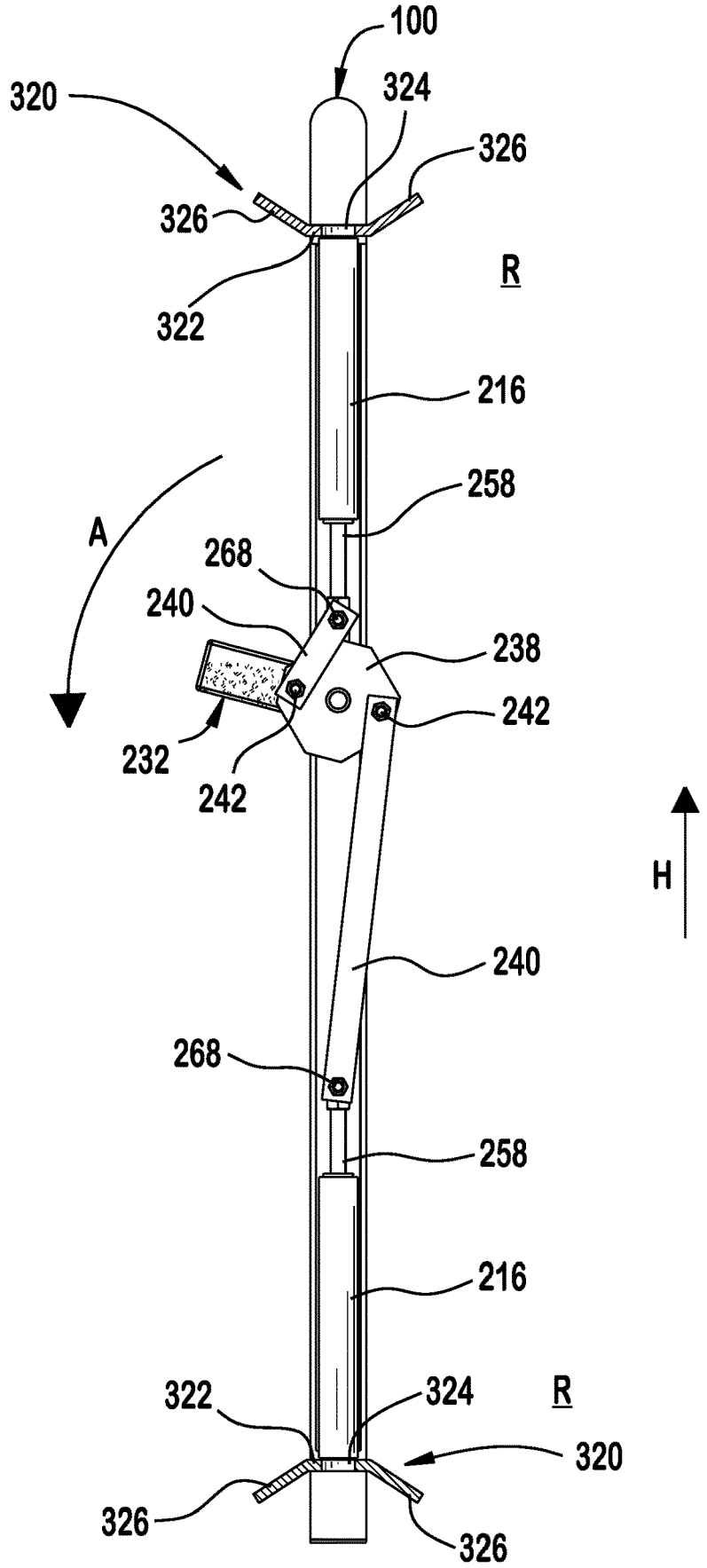
FIG. 7 is a sectional side view of the hinge assembly in a retracted position and the support bracket.

To actuate the actuating assembly 230, the user grasps the lever 232 and rotates the lever 232 along an actuating rotation direction A from a first position of the lever 232 shown in FIG. 1 to a second position of the lever 232 shown in FIGS. 6 and 7. The rotation of the lever 232 from the first position to the second position correspondingly rotates the actuating plate 238 along the actuating rotation direction A. Rotation of the actuating plate 238 along the actuating rotation direction A, as shown in a comparison of FIG. 5 to FIGS. 6 and 7, moves the translation bars 240 toward each other, which moves the pins 252 attached to the translation bars 240 from the extended position E shown in FIG. 5 toward each other along the height direction H and counter to the height direction H to the retracted position R shown in FIGS. 6 and 7. In the retracted position R, as shown in FIGS. 6 and 7, each pin 252 is fully contained within the pin receiving passageway 218 of the pin guide 216 and no longer extends into the pin end receiving passageway 324 of the corresponding catch 320. The pin 252 thus no longer engages the catch 320 in the retracted position R and the hinge assembly 200 is free to move with respect to the corresponding support bracket 300.

In the retracted position R, as shown in FIG. 6, the spring 260 is compressed between the cylindrical portion 254 of the pin 252 and the stopper 262 and imparts a biasing spring force S urging the pin 252 back to the extended position E. Consequently, the pin 252 only stays in the retracted position R while the user holds the lever 232 in the second position. Upon release of the lever 232, the spring 260 moves the pin 252 back to the extended position E and the lever 232 back to the first position.

In the following description with respect to FIGS. 8 and 9, for ease of understanding, the hinge assembly 200 on one side of gate body 100 will be referred to as the first hinge assembly 200-1 and the hinge assembly 200 on the opposite side of the gate body 100 in the longitudinal direction L will be referred to as the second hinge assembly 200-2. Each of the first hinge assembly 200-1 and second hinge assembly 200-2 is representative of and is identical to the hinge assembly 200 described above. The support brackets 300 shown in FIGS. 8 and 9 correspond to the hinge assemblies 200-1, 200-2; a first support bracket 300-1 is attached to the barrier 400 facing the opening 410 and adjacent the side of the gate body 100 having the first hinge assembly 200-1, and a second support bracket 300-2 is attached to the barrier 400 facing the opening 410 and adjacent the side of the gate body 100 having the second hinge assembly 200-2. Each of the support brackets 300-1, 300-2 is representative of and is identical to the support bracket 300 described above.

Figure 8:
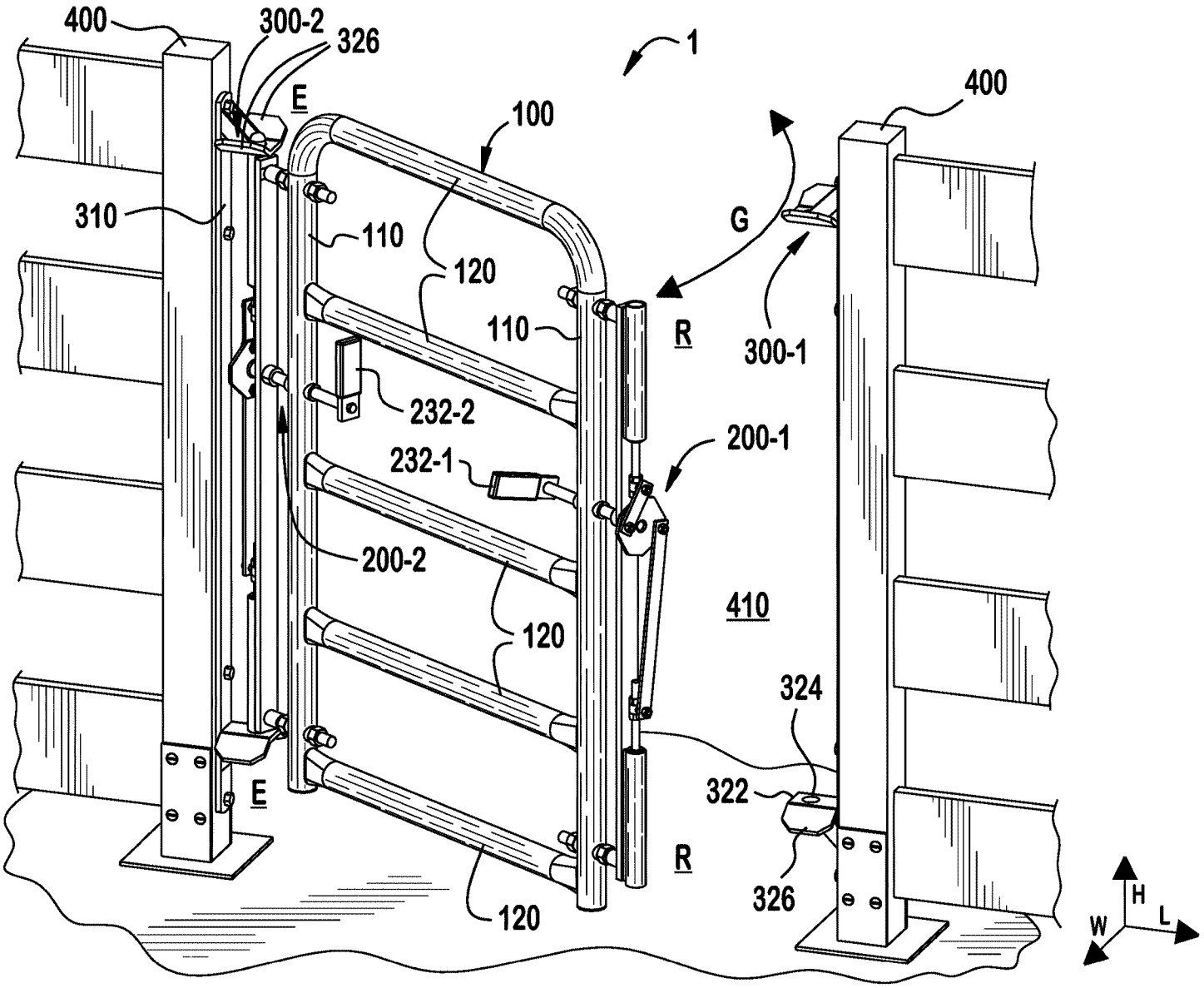
FIG. 8 is a perspective view of the gate in a first open position.
Figure 9:
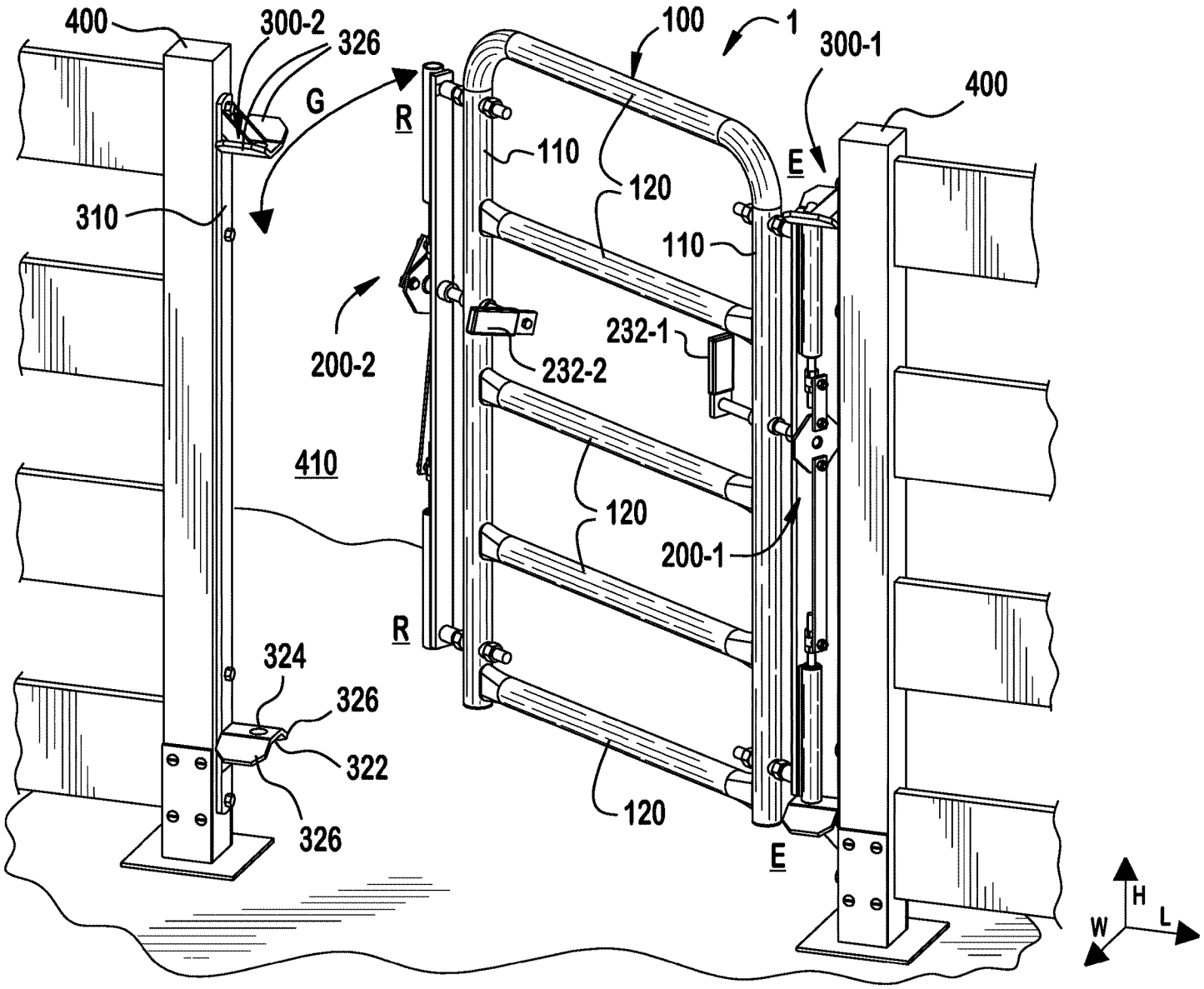
FIG. 9 is a perspective view of the gate in a second open position.

As shown in FIG. 8, with the pins 252 of the first hinge assembly 200-1 in the retracted position R due to the user's rotation of the lever 232-1, the user can rotate the gate body 100 either in or out from the barrier opening 410 along a gate rotation direction G. The gate rotation direction G has a rotational axis extending along the height direction H through the pins 252 of the second hinge assembly 200-2; the pins 252 of the second hinge assembly 200-2 remain in the extended position E and, by virtue of being cylindrical, can rotate within the pin end receiving passageways 324 while remaining secured to the catches 320 of the second support bracket 300-2. Likewise, as shown in FIG. 9, the pins 252 of the second hinge assembly 200-2 may be moved to the retracted position R by operation of the lever 232-2 while the first hinge assembly 200-1 remains engaged with the first support bracket 300-1, permitting rotation along the gate rotation direction G about a rotational axis extending along the height direction H through the pins 252 of the first hinge assembly 200-1. The gate body 100 can thus be opened at the hinge assembly 200-1, 200-2 at either side of the opening 410 and rotated either in or out with respect to the opening 410. Further, a user may operate the levers 232-2 and 232-2 to disengage both the first hinge assembly 200-1 and the second hinge assembly 200-2 from the support brackets 300-1, 300-2, permitting complete removal of the gate body 100 from the barrier opening 410.

Figure 10:
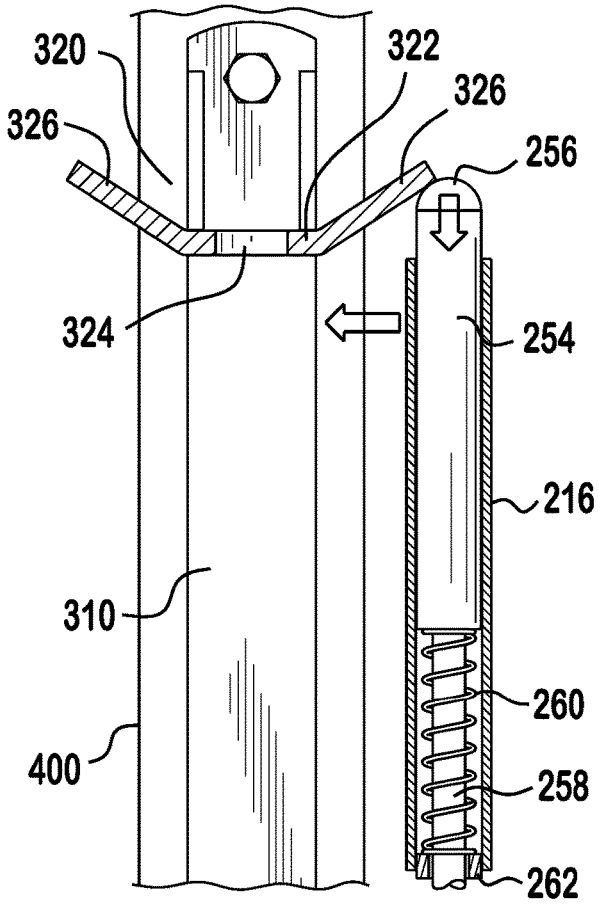
FIG. 10 is a detailed sectional side view of the hinge assembly and the support bracket.

With the pins 252 of either hinge assembly 200-1, 200-2 held in the retracted position R by the user, the hinge assembly 200-1, 200-2 can be re-engaged with the support bracket 300-1, 300-2 by aligning the pin 252 with the pin end receiving passageway 324 and releasing the lever 232. Release of the lever 232 allows the spring 260 to move the pin 252 back to the extended position E and engage the pin end receiving passageway 324. Alternatively, the user may release the lever 232 in a position in which the pin 252 is not aligned with a pin end receiving passageway 324. In this case, when the hinge assembly 200 is moved back to re-engage the support bracket 300 as shown in FIG. 10, the rounded tip 256 of the pin 252 abuts one inclined side portion 326 of the catch 320. The pin 252 continues to abut the inclined side portion 326, which pushes the pin 252 into the pin guide 216 and compresses the spring 260, as the hinge assembly 200 is moved further toward alignment with the support bracket 300. When the hinge assembly 200 is fully aligned with the support bracket 300, the pin 252 is aligned with the pin end receiving passageway 324 and the spring 260 pushes the pin 252 put of the pin guide 216 to engage the pin end receiving passageway 324 as shown in FIG. 5.

The foregoing illustrates some of the possibilities for practicing the invention. Many other embodiments are possible within the scope and spirit of the invention. Therefore, more or less of the aforementioned components can be used to conform to that particular purpose. It is, therefore, intended that the foregoing description be regarded as illustrative rather than limiting, and that the scope of the invention is given by the appended claims together with their full range of equivalents.

What is claimed is:

1. A gate comprising:

a gate body;

a hinge assembly attached to a first side of the gate body and having: a first pin assembly with a first pin having a spring disposed around a threaded portion of the first pin, the first pin movably disposed between an extended and a retracted position in a first pin receiving passageway of a first pin guide, such that in the extended position, a cylindrical portion of the first pin having a rounded tip protrudes from the first pin guide, and in the retracted position, the rounded tip of the first pin does not protrude from the first pin guide; and an actuating assembly urging the first pin between the retracted position and the extended position; and a support bracket engaging the first pin in the extended position and disengaged from the first pin in the retracted position, the gate body having an axis of rotation extending through the first pin when the first pin engages the support bracket and being freely movable with respect to the support bracket when the first pin is disengaged from the support bracket.

2. The gate of claim 1, wherein the support bracket includes a first catch having a first central portion with a first pin end receiving passageway extending through the first central portion.

3. The gate of claim 2, wherein the first catch has a pair of inclined side portions disposed on each of two opposite sides of the central portion at an angle with respect to the central portion.

4. The gate of claim 2, wherein the first pin is disposed in and rotatable within the first pin end receiving passageway in the extended position.

5. The gate of claim 4, wherein the hinge assembly includes a second pin assembly, the actuating assembly capable of moving a second pin of the second pin assembly between a retracted position and an extended position.

6. The gate of claim 5, wherein the support bracket has a second catch disposed opposite the first catch, the second catch having a second central portion with a second pin end receiving passageway extending through the second central portion.

7. The gate of claim 6, wherein the second pin is disposed in and rotatable within the second pin end receiving passageway in the extended position.

8. The gate of claim 1, wherein the first pin is movable between the retracted position and the extended position along a height direction perpendicular to a longitudinal direction extending between the first side of the gate body and an opposite second side of the gate body.

9. The gate of claim 1, wherein the actuating assembly includes a lever rotatable along an actuating rotation direction between a first position of the lever and a second position of the lever.

10. The gate of claim 9, wherein the first pin is in the extended position when the lever is in the first position and the first pin is in the retracted position when the lever is in the second position.

11. The gate of claim 10, wherein the actuating assembly includes an actuating rod fixed to the lever and an actuating plate fixed to the actuating rod.

12. The gate of claim 11, wherein the actuating rod extends through a vertical support of the gate body on the first side of the gate body.

13. The gate of claim 11, wherein rotation of the lever between the first position of the lever and the second position of the lever correspondingly rotates the actuating plate along the actuating rotation direction.

14. The gate of claim 13, wherein the actuating assembly includes a first translation bar connecting the actuating plate to the first pin.

15. The gate of claim 14, wherein rotation of the actuating plate along the actuating rotation direction imparts linear motion to the first pin via the first translation bar.

16. The gate of claim 13, wherein the hinge assembly includes a second pin assembly, the actuating assembly capable of moving a second pin of the second pin assembly between a retracted position and an extended position.

17. The gate of claim 16, wherein the actuating assembly includes a second translation bar connecting the actuating plate to the second pin, rotation of the actuating plate along the actuating rotation direction imparting linear motion to the second pin via the second translation bar.

18. The gate of claim 16, wherein the second pin moves between the retracted position and the extended position of the second pin in a second direction opposite to a first direction in which the first pin moves between the retracted position and the extended position of the first pin.

19. The gate of claim 16, wherein the support bracket engages the first pin and the second pin in the extended position and is disengaged from the first pin and the second pin in the retracted position.

20. The gate of claim 19, wherein the axis of rotation of the gate body extends through the first pin and the second pin when the first pin and the second pin engage the support bracket.

21. The gate of claim 20, wherein the gate body is freely movable with respect to the support bracket when the first pin and the second pin are disengaged from the support bracket.

22. The gate of claim 1, wherein the first pin assembly has a stopper disposed in the pin guide retaining the first pin and the spring within the first pin receiving passageway.

23. The gate of claim 22, wherein, in the retracted position, the spring is compressed between the cylindrical portion of the first pin and the stopper and biases the first pin toward the extended position.

24. The gate of claim 1, wherein the support bracket is attached to a barrier adjacent an opening of the barrier.

25. A gate, comprising:

a gate body;

a first hinge assembly attached to a first side of the gate body, the first hinge assembly including a first pin assembly and a first actuating assembly capable of moving a first pin of the first pin assembly between a retracted position and an extended position of the first pin;

a second hinge assembly attached to a second side of the gate body opposite the first side of the gate body, the second hinge assembly including a second pin assembly and a second actuating assembly capable of moving a second pin of the second pin assembly between a retracted position and an extended position of the second pin;

a first support bracket engaging the first pin in the extended position and disengaged from the first pin in the retracted position, the gate body having a first axis of rotation extending through the first pin when the first pin engages the first support bracket and being freely movable in either direction, with respect to the first support bracket when the first pin is disengaged from the first support bracket; and a second support bracket engaging the second pin in the extended position and disengaged from the second pin in the retracted position, the gate body having a second axis of rotation extending through the second pin when the second pin engages the second support bracket and being freely movable in either direction, with respect to the second support bracket when the second pin is disengaged from the second support bracket.

26. The gate of claim 25, wherein the first hinge assembly has a third pin assembly, the first actuating assembly capable of moving a third pin of the third pin assembly between a retracted position and an extended position of the third pin.

27. The gate of claim 26, wherein the first pin moves between the retracted position and the extended position of the first pin in a height direction perpendicular to a longitudinal direction extending between the first side and the second side of the gate body.

28. The gate of claim 27, wherein the third pin moves between the retracted position and the extended position of the third pin in a direction opposite to the height direction.

29. The gate of claim 28, wherein the third pin engages the first support bracket in the extended position and is disengaged from the first support bracket in the retracted position.

30. The gate of claim 25, wherein each of the first and second actuating assemblies include a lever rotatable along an actuating rotation direction between a first position of the lever and a second position of the lever.

31. The gate of claim 30, wherein the first pin is in the extended position when the lever of the first actuating assembly is in the first position and the first pin is in the retracted position when the lever of the first actuating assembly is in the second position.

32. The gate of claim 30, wherein the second pin is in the extended position when the lever of the second actuating assembly is in the first position and the second pin of the second actuating assembly is in the retracted position when the lever of the second actuating assembly is in the second position.

33. The gate of claim 30, wherein each of the actuating assemblies include an actuating rod fixed to the lever and an actuating plate fixed to the actuating rod.

34. The gate of claim 33, wherein rotation of the lever between the first position of the lever and the second position of the lever correspondingly rotates the actuating plate along the actuating rotation direction.

* * * * *